United States Patent [19]

Horton

[11] 4,172,292

[45] Oct. 30, 1979

[54] VEST-TYPE GARMENT HAVING A HANDHOLD

[76] Inventor: Edward M. Horton, Rt. #1, Box 244, Keswick, Va. 22947

[21] Appl. No.: 887,723

[22] Filed: Mar. 17, 1978

[51] Int. Cl.[2] ..... A41D 1/04; A41D 11/00

[52] U.S. Cl. ..... 2/102

[58] Field of Search ..... 2/75, 88, 92, 93, 94, 2/102, 271

[56] References Cited

U.S. PATENT DOCUMENTS

| | | | |
|---|---|---|---|
| 811,167 | 1/1906 | Paddock | 2/92 |
| 970,824 | 9/1910 | Hoppenstein | 2/102 |
| 1,475,072 | 11/1923 | Langerman | 2/102 |
| 1,486,676 | 3/1924 | Nilssen | 2/102 |
| 1,722,753 | 7/1929 | Kerr | 2/88 |
| 1,740,614 | 12/1929 | Marquist | 2/88 |
| 2,229,593 | 1/1941 | Russo | 2/102 |
| 3,529,307 | 9/1970 | Belson et al. | 2/94 |
| 3,997,921 | 12/1976 | Knight | 2/271 |

*Primary Examiner*—Louis Rimrodt

*Attorney, Agent, or Firm*—Schwartz, Jeffery, Schwaab, Mack, Blumenthal & Koch

[57] ABSTRACT

A garment is disclosed by which a person other than the wearer may firmly engage his hand with the garment. The garment is particularly useful for aiding handicapped persons in riding horses. During such use of the garment, an attendant's hand is engaged with the back side of the garment to support the rider. The snug hand engagement may be by way of a horizontal strap at the lower portion of the back side of the garment near the wearer's hip and lower back region, by way of a horizontal strap in the upper portion of the garment in the region of the wearer's shoulder blades, or by way of straps in both places. Also, vertical straps may be provided to effect handholds for gripping the garment. The garment has uses other than in handicapped horseback riding. For example, the garment is useful in providing a handhold for the rear person in tandem riding situations such as with motorcycles, bicycles, snowmobiles, sleds and the like.

18 Claims, 8 Drawing Figures

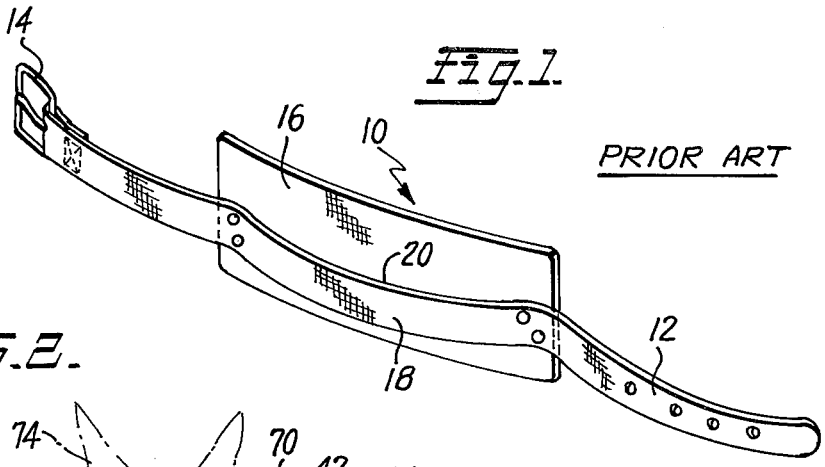
Fig. 1.
PRIOR ART
Fig. 2.
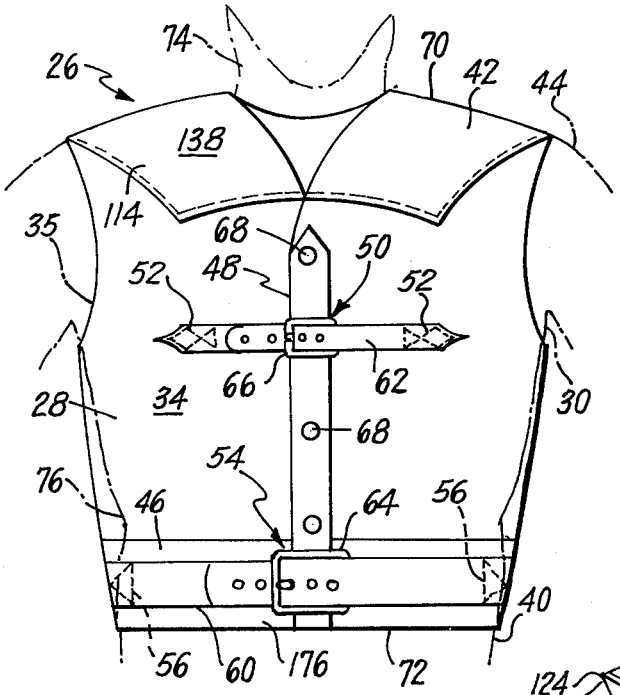
Fig. 3.
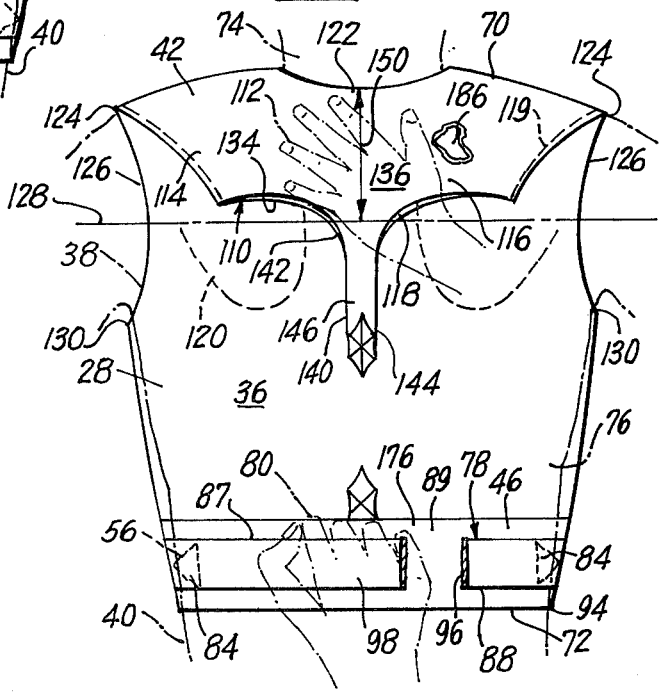

VEST-TYPE GARMENT HAVING A HANDHOLD

BACKGROUND OF THE INVENTION

1. Field of the Invention

This invention relates to the field of garments having handholds for persons other than the wearer.

2. Description of the Prior Art

It has been known to provide a web waist belt with a loop-like rear handle and to secure such belt around the waist of a handicapped horseback rider to provide a handhold for an attendant or "walker" who walks along with the horse and holds onto the handicapped rider to stabilize him and prevent his falling. In this regard, handicapped horseback riding is a growing activity, and it has been found that most handicapped persons are capable of engaging in horseback riding if aided by an attendant or "walker" as described. Horseback riding has been found to be a great benefit to handicapped persons in providing both therapeutic and recreational opportunities. North American Riding for the Handicapped Association, Inc. is a national organization coordinating activities of handicapped horseback riding groups throughout this country.

The aforementioned prior art web waist belt used by handicapped horseback riders is illustrated in FIG. 1 and it is generally referred to there by reference character 10. Web waist belt 10 includes a conventional belt portion 12 which extends around the handicapped rider's waist and which is fastened by a standard buckle 14. Web waist belt 10 includes a web portion 16 which engages the handicapped rider's back and a loop portion 18 which defines an opening 20 with respect to web portion 16. An attendant's hand is inserted through opening 20 to support and stabilize the handicapped rider.

The known type of web waist belt has certain deficiencies. It must be fastened around the rider's waist, since in other positions it would have a tendency to creep and slide. The web waist belt can be uncomfortable since it concentrates all the stresses of the support in the waist area of the rider. More importantly, positioning of the loop portion 18 in the area of the rider's waist tends to cause the handicapped rider to assume an undesirable posture when on the horse. In particular, providing support at the waist of the rider tends to push the rider's torso forward into an uncomfortable and sometimes medically unsafe position. In general, the web waist belt of the prior art tends to provide inadequate back support for the handicapped person.

It is also known to provide a garment with one or more handholds for persons other than the wearer. For example, U.S. Pat. No. 3,997,921 to Knight shows a garment for controlling a child, the garment having a horizontal control handle incorporated into the back side of the garment, preferably on the collar portion. Such a garment, while being suitable for holding a child from above, would not be suitable for supporting a handicapped horseback rider from below, and would be generally unsuitable for providing firm back support for a handicapped person by engagement of a flattened hand with the back of the garment.

U.S. Pat. No. 3,553,107 to Raneri et al. and U.S. Pat. No. 3,562,812 to Greggains show safety garments for rear riders in tandem motorcycle riding. In both instances, a handhold is provided for the rear rider, but in neither case is the handhold of a type which is suitable for remaining a permanent, integral part of the garment and appropriately remain in place as part of the garment when the garment is not being used to provide a handhold for the rear tandem rider.

3. Objects of the Invention

It is an object of the present invention to provide a garment for aiding a handicapped wearer in riding horses under circumstances wherein an attendant stabilizes the rider on the horse.

It is a related object of the invention to provide a garment for aiding a handicapped horseback rider wherein the handhold for an attendant is not located in the immediate region of the rider's waist;

Other related objects of the invention are to provide a garment for aiding a handicapped horseback rider, which garment is comfortable, which distributes the stresses from the handholds throughout the rider's upper body, which effects a desirable posture for the handicapped rider when on the horse, and which provides adequate back support for the handicapped rider on the horse;

It is another object of the invention to provide a safety garment providing handholds which are suitable for stabilizing large handicapped persons when riding horseback and/or which are suitable for riders with a spina bifida or other spinal handicaps;

It is another object of the invention to provide a safety garment with handholds suitable for grasping by a rear rider in tandem vehicle riding, the handholds being such as to be suitable for remaining a permanent integral part of the garment; i.e. handholds which may appropriately remain in place as part of the garment when the garment is not being used to provide a handhold;

Other objects and advantages of the present invention will be apparent from the accompanying detailed description and drawing.

SUMMARY

The foregoing objects are achieved by providing a garment comprising means for covering the torso of a handicapped rider, the covering means having a back side for covering the rider's back, a front side for covering the rider's chest, an upper portion, coextensive with the front and back portions, for covering the rider's shoulders, and a lower portion for circumscribing the rider's hips; a closure in the front side of the covering means; releasable fastening means on the front side of the covering means and cooperating with the closure to firmly secure the covering means on the rider; and means in the lower portion of the covering means at the back side thereof and below the wearer's waist for effecting engagement with an attendant's hand.

Alternatively, or in addition to the lower means for effecting hand engagement, there may be an upper means for effecting hand engagement in the upper portion of the covering means at the back side thereof. The hand engaging means may effect snug engagement with an attendant's flattened hand when in face-to-face engagement with the back side of the covering means. The lower means for effecting hand engagement is disposed so as to be at the lower back and upper hip region of the wearer, below the wearer's waist. The upper means for effecting hand engagement is so disposed as to be generally centrally disposed with respect to the wearer's shoulder blades.

Both the upper and lower means for effecting hand engagement may include support members of flexible inelastic material having a first part affixed to the covering means of the garment and a second part which is free of the covering means. Each means for effecting hand engagement includes an aperture, opening or passage extending between the support member and covering means. The support members both include a frontwardly facing side and a rearwardly facing side, the frontwardly facing side being adapted for tight engagement with the attendant's hand, the rearwardly facing side facing exteriorly of the garment. The support members may take the form of horizontal straps each having a central portion intermediate its ends, the first affixed part of each support member being disposed at the ends of the strap, and the second free part of the support member being in the central portion of the strap.

Alternatively, the upper support member may be closed at the upper end of the covering means opposite a downwardly facing, lower aperture of the upper support member, the upper support member having the form of an inverted pocket into which an attendant's hand may be inserted from below.

The upper support member may include an auxiliary support member extending vertically downwardly therefrom, the auxiliary support member having upper and lower ends and an intermediate region therebetween. The upper end of the auxiliary support member is integral with the second free part of the upper support member and is free of the covering means. The intermediate region of the auxiliary support member is free of the covering means, and the lower end of the auxiliary support member is affixed to the back side of the covering means. The auxiliary support means provides a vertically disposed handle adapted for grasping by an attendant to support the handicapped wearer on the horse. Such auxiliary means may also be useful in other respects, such as for grasping by a rear, tandem vehicle rider.

The upper horizontal support member may extend across part of the back side of the covering means at a level between, on the one hand, the top ends of arm openings and the neck opening in the covering means, and, on the other hand, the bottom ends of the arm openings. More particularly, the horizontal support member may be disposed at a level approximately halfway between, on the one hand, the top ends of the arm openings and the neck opening, and on the other hand, the bottom ends of the arm openings, whereby the horizontal support member is approximately centrally located with respect to the wearer's shoulder blades. p As another alternative, the upper support member may extend horizontally across part of the back side of the covering means and vertically downwardly from the neck opening and the top of the arm openings of the covering means to at least a level which is halfway between the tops and bottoms of the arm openings. This will be the case when the support member of the upper hand engaging means takes the form of an inverted pocket. In such instance, the support member preferably extends vertically downwardly a distance approximately equal to the length of an average human hand, and in particular extends vertically downwardly to an extent falling in the range of 7–8 inches.

In another embodiment, the garment has left and right regions on the back side thereof with a left vertical strap in the left region and a right vertical strap in the right region, each of the straps having upper and lower ends and an intermediate region, each of the straps extending between the upper and lower portions of the covering means, the upper end of each strap being affixed to the covering means in the upper portion thereof, the lower end of each strap being affixed to the covering means in the lower portion thereof, the intermediate region of each strap being free of the covering means, whereby each strap provides a handhold for a person other than the wearer. Such construction is particularly suitable for large handicapped horseback riders, horseback riders with a spina bifida or other spinal handicap, and rear tandem vehicle riders. Such construction also involves a garment where the handholds may be an integral part of the garment and yet appropriate as part of the garment when not providing a handhold. Such garment may also include upper or lower horizontal support means as described above, or both. Such garment may also include reinforcing means to aid in distributing stresses from the handholds throughout the upper body of the wearer, and in particular to transfer such stresses to the hips and shoulders of the wearer.

BRIEF DESCRIPTION OF THE DRAWING

FIG. 1 is a perspective view of a prior art web waist belt for handicapped horseback riders;

FIG. 2 is an elevational view of the front side of the preferred embodiment of a garment according to the present invention;

FIG. 3 is an elevational view of the rear side of the garment of FIG. 2 showing, in phantom lines, the cooperation between the garment and the hands of attendants for handicapped horseback riders and showing, for purposes of illustration, a section out of the lower support member;

DETAILED DESCRIPTION

Figure 4:
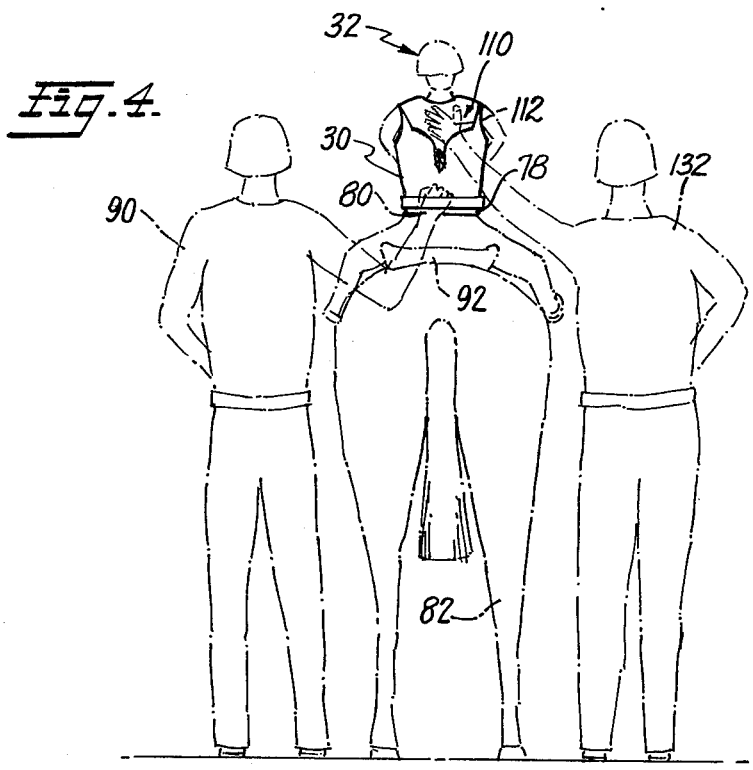
FIG. 4 is an elevational view showing use of the garment of FIG. 1 for aiding a handicapped wearer in riding a horse under circumstances wherein hands of attendants are used to stabilize the handicapped rider on the horse.

In the following description, and in the drawing, like reference characters, when used in connection with various different figures of the drawing, refer to like elements or features.

As previously pointed out, FIG. 1 shows a web waist belt 10 of the prior art including a belt portion 12, a buckle 14, a web portion 16, a loop portion 18 and an opening in the loop portion 20. As also discussed, this web waist belt 10 has deficiencies in that substantially all the stresses generated by an attendants holding the loop portion 18 are transferred to the rider's waist. Holding the handicapped rider in the waist area tends to push the rider's torso forward into an undesirable position and does not provide adequate back support.

A preferred embodiment of the present invention for overcoming such deficiencies is shown in FIGS. 2 and 3. There, reference numeral 26 generally refers to the garment of the invention. Garment 26 includes a covering 28 for the torso or trunk 30 of a handicapped rider 32 (FIG. 4). A front side 34 for covering the rider's chest 35 is shown in FIG. 2. FIG 3 shows the back side 36 of covering 28 for covering the rider's back 38, including the upper hip and lower back region 40 of rider 32. Covering 28 includes an upper portion 42 coextensive with the front and back sides 34, 36, for covering the rider's shoulders 44. Covering 28 also includes a lower portion 46 circumscribing the rider's hips, specifically, the rider's upper hip and lower back region 40.

In front side 34 of covering 28 is a closure 48. Cooperating with closure 48 to firmly secure covering 28 on the rider 32 are releasable fastening means which preferably take the form of an upper buckling device 50 with ends affixed to covering 28 by sewing at 52 and a lower buckling device 54 affixed to the lower portion 46 of the covering 28 preferably by stitching 56. Lower buckling device 54 includes a thicker strap 60 than the strap 62 of buckling device 50. Also buckle 64 of lower buckling device 54 is larger than the analogous buckle 66 of upper buckling device 50. This is for the reason that the lower buckling device 54 receives greater stresses during use with a hand engaging means on the back side of covering 28 than does upper buckling device 50. In this same regard, a secure fastening of the lower portion 46 around the hips 40 of the wearer 32 is important for transferring at least part of the stresses produced by use of the garment 26 to the hips 40 of the wearer. Preferably in addition to buckling devices 54, 58, there are also conventional snap fasteners 68 cooperating with the closure 48 to releasably close the same.

Covering 28 includes an upper end 70 and a lower end 72. Upper end 70 terminates at the wearer's shoulder 44 and the base of the wearer's neck 74. Lower end 72 is disposed at the upper hip and lower back region 40 of the wearer 32, and well below the waist 76 of the wearer. Upper portion 42 terminates at one side in upper end 70 and lower portion 46 terminates on one side at lower end 72.

Referring to FIG. 3, there is in lower portion 46 of the covering 28 at the back side 36 thereof a support member 78 for effecting snug, gripping engagement with an attendant's hand 80 to stabilize the handicapped rider 32 on a horse 82 (FIG. 4). Lower support member 78 is of a flexible, substantially inelastic material such as woven cloth or leather. Lower support member 78 has a first part 84 affixed to lower portion 46 of covering 28 by stitching 56 and a second part 86 which is free of covering 28. There is an upper opening 87 and a lower opening 88 defining a passage 89 between lower support member 78 and covering 28. The upper opening 87 faces upwardly toward the upper end 70 of covering 28 and the lower opening 88 faces downwardly toward lower end 72 of covering 28. By locating lower support member 78 in the hip and lower back region 40, an attendant 90 is able to assure good posture of the handicapped rider 32 when his hand grips the lower support member 78. In particular, the attendant 90 is able to properly orient the wearer's hips upright in the saddle 92.

Passage 89 is of such size as to effect tight engagement with the attendant's hand 80, and, specifically, his fingers. Support member 78 preferably is an extension of strap 60, i.e., a one-piece strap extends entirely around lower portion 46 of cover 28.

Lower support member 78 includes a frontwardly facing side 96 and a rearwardly facing side 98, the frontwardly facing side engaging the back of the attendant's fingers, the rearwardly facing side facing exteriorly of the garment 26. Upper opening 87 of lower support member 78 facilitates passing the end of the attendant's hand 80 through lower support member 78 for effecting hand engagement as shown in FIGS. 3 and 4. As indicated, the lower support member takes the form of a horizontal belt, and the belt has a central portion corresponding to above-described second part 86, the central portion being intermediate the ends of the strap. What may be regarded as the first affixed part 84 of lower support member 78 is disposed, in a broad sense, at the ends of the strap, although in the particular embodiment shown the strap continues around the front of the garment, with the second free part 86 being in the central portion of the strap between the ends which here are defined by stitching 56.

In the upper portion 42 of the covering 28 of garment 26 at the back side 36 thereof is an upper support member 110 for effecting snug engagement with an attendant's flattened hand 112 when hand 112 is in face-to-face engagement with the back side 36 of the covering 28 near the upper portion 42 of the covering 28 of the garment. Upper support member 110 may be used either alone or in conjunction with lower support member 78 to stabilize the handicapped rider 32 on a horse 82. Upper support member 110 is of a flexible, substantially inelastic material such as woven cloth or leather. Upper support member 110 has a first part 114 affixed to upper portion 42 of covering 28 and a second part 116 which is free of covering 28. There is a lower opening 118 facing downwardly toward lower end 72 of covering 28 to facilitate upward insertion of the attendant's hand 112 in a direction toward the upper end 70 of covering 28.

In the embodiment as shown in FIGS. 2 and 3, the affixing of first part 114 to the covering 28 is effected by stitching 119 as shown. As shown in FIG. 3, at least part of the upper support member 110, and specifically in FIG. 3, the lowermost part which defines lower opening 118, is disposed at a vertical level which is approximately at the center of the wearer's shoulder blades 120. In particular, upper support member 110 extends horizontally across at least part of back side 36 of covering means 28 and vertically downwardly from a neck opening 122 and from the tops 124 of arm openings 126 so that its lowest part is at least at a level shown by center line 128 of FIG. 3. Centerline 128 is at a level halfway between tops 124 and bottoms 130 of arm openings 126. Centerline 128 also corresponds with the aforementioned center of the wearer's shoulder blades. Arm openings 126 are of the conventional, oppositely disposed type with tops and bottoms 124, 130, and neck opening 122 is disposed at the base of the wearer's neck 74.

By locating upper support member 110 such that the attendant's hand will be placed flatly against the horseback rider's shoulder blade region 120 and held tightly against such region, the attendant 132 (shown on the right side of FIG. 4) will also be able to assure good posture of the handicapped rider 32 either with or without the additional support provided by attendant 90 (shown on the left side of FIG. 4) in the upper hip and lower back region 40 of the wearer. In particular, the attendant 132 is able to hold the upper torso portion of the rider 32 in an erect position and properly orient the upper torso portion including the shoulders 44 and rib cage with respect to the horse 82 while at the same time providing support for the upper torso including the rib cage and shoulders of the rider.

Upper support member 110 includes a frontwardly facing surface 134 and a rearwardly facing surface 136. The frontwardly facing surface 134 tightly engages the back of the attendant's hand 112, and the rearwardly facing surface 136 faces exteriorly of the garment. In the embodiment shown in FIG. 3, the upper support member is closed at the upper end 70 of covering 28 and opposite lower aperture 118. Thus, upper support member 110 has the form of an inverted pocket into which the attendant's hand 112 may be inserted from below. The closing at upper end 70 may either be by stitching or simply be by the engagement of the fabric of support member 110 with covering 28 at the shoulder 44 of the wearer. In the latter instance, stitching will be provided in a flap 138 on the front side 34 (FIG. 2) of the covering 28, which flap 138 is of one piece with upper support member 110. As shown in FIG. 3, flap 38 and upper support member 110 are given an ornamental western design so that the garment 26 has a pleasing appearance, particularly in the context of horseback riding.

Upper support member 110 includes an auxiliary support member 140 extending vertically downwardly therefrom. The auxiliary support member 140 has an upper end 142 and a lower end 144 with an intermediate region 146 therebetween. The upper end 142 of auxiliary support member 140 is integral with and of one piece with the second free part 116 of the upper support member 110, and thus upper end 142 is free of the covering 128. The intermediate region 146 of auxiliary support 140 is also free of covering 28. The lower end 144 of auxiliary support member 140 is affixed to back side 136 of the covering 28 by an ornamental fixture 148. Auxiliary support member 140 provides a vertically disposed handle for grasping by an attendant 90 or 132 to support the handicapped wearer on a horse. Auxiliary support member 140 is particularly useful for providing a firm grip on the rider 32 when mounting or dismounting or for catching the rider if he tends to slip. Also, auxiliary support member 140 may provide a handle for a rear rider in tandem vehicle riding.

Figure 5:
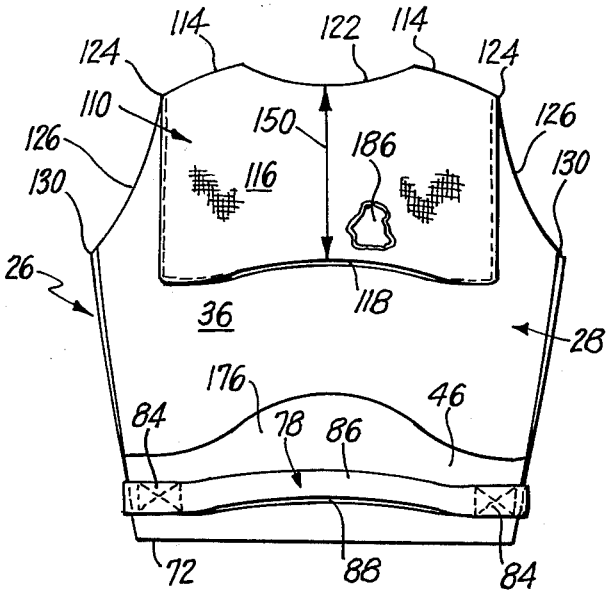
FIG. 5 is an elevational view of the rear side of a garment according to another embodiment of the invention.

In the embodiments of FIGS. 2 and 3, the upper support member 110 extends across at least part of the back side 36 of covering 28 at a level between the top end 124 of arm openings 126 and the neck opening 122, on the one hand, and the bottom ends 130 of arm openings 126 on the other hand. This is also true of the embodiments shown in FIGS. 5 and 6, but it is noted that in the embodiment of FIG. 5 the lower aperture 118, and thus the lower end of upper support member 110 is disposed below the level of the bottom ends 130 of arm openings 126. The garment of FIG. 5 is intended for a smaller handicapped rider, i.e., a small child. As in FIG. 3, upper support member 110 as shown in the embodiment of FIG. 5 is closed at the upper end to form an inverted pocket. Because covering 28 of the smallest vest of FIG. 5 is smaller than that of the embodiment of FIGS. 2 and 3, upper support member 110 is proportionally larger with respect to the garment 26. Nevertheless, the support members 110 of FIGS. 3 and 5 extend downwardly approximately the same distance from the lowermost point of neck opening 22. In the garments of both the embodiments of FIGS. 3 and 5, upper support member 110 extends vertically downwardly from neck opening 122 a distance 150 approximately equal to the length of an average human hand. In particular, support member 110 of both embodiments extends downwardly to an extent falling in the range of 7–8 inches.

Figure 6:
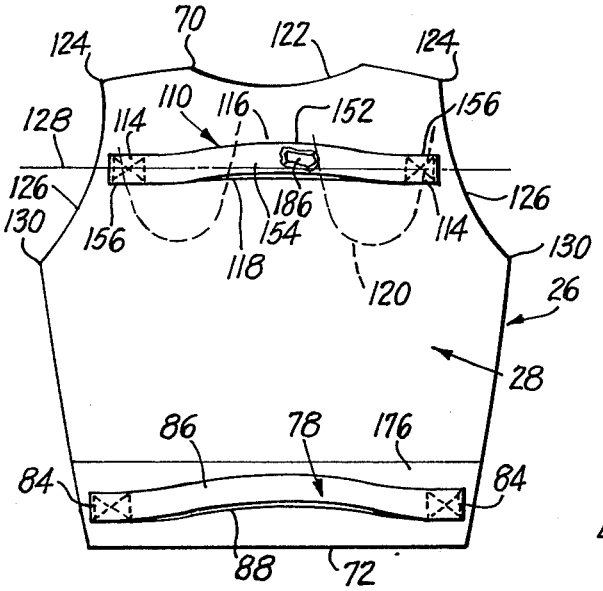
FIG. 6 is an elevational view of the rear side of a garment according to yet another embodiment of the invention.

In the embodiment shown in FIG. 6, upper support member 110 takes the form of a horizontal strap. Here, the strap is preferably disposed approximately along center line 128 as defined in connection with the embodiment of FIG. 3. In particular, horizontal support member 110 of the embodiment of FIG. 6 is disposed at a level approximately halfway between, on the one hand, the top ends 124 of arm openings 126 and neck opening 122 and, on the other hand, the bottom ends 130 of arm openings 126, the horizontal support member 110 thereby being approximately centrally located with respect to the shoulder blades 120 of the wearer.

In the embodiment of FIG. 6, horizontal support member or strap 110 includes an upper aperture 152 between it and the covering 28, the upper aperture 152 facing upwardly toward the upper end 70 of the covering 28 to facilitate either passing of the end of the attendant's hand upwardly through upper support member 110 or passing of the attendant's hand downwardly through aperture 152 to effect the same type of gripping engagement as shown in connection with lower support member 78 if the attendant can reach that far in his gripping of upper support member 110. Upper support member 110 as per FIG. 6 includes a central portion 154 intermediate its ends 156, the first affixed parts 114 being disposed at the ends 156 and the second free part 116 being disposed in the central portion 154.

In the embodiments of FIGS. 5 and 6, lower support member 78 has the same characteristics as that described in connection with FIG. 3 except that the ends of the strap forming the lower support member terminate at the back side 36 of the covering 28 rather than extending around to the front and buckling.

Figure 7:
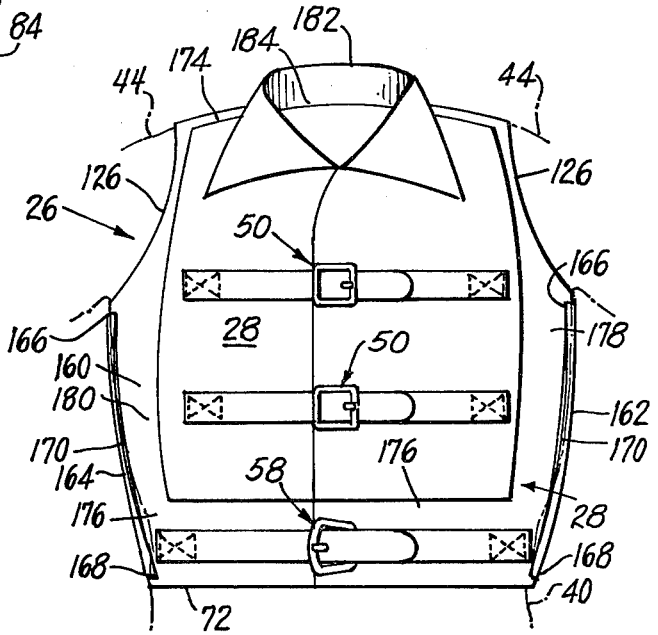
FIG. 7 is an elevational view of the front side of a garment according to a still further embodiment of the present invention.
Figure 8:
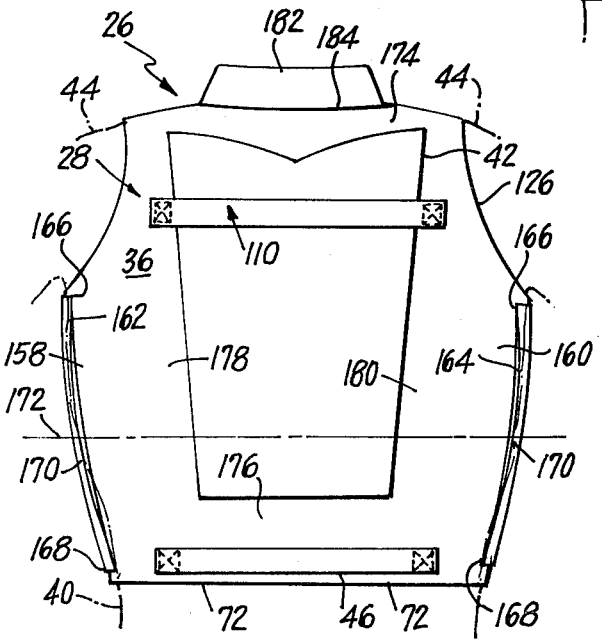
FIG. 8 is an elevational view of the rear side of the garment of FIG. 7.

In the embodiments of FIGS. 7 and 8, there is shown a garment which is particularly suitable for large handicapped horseback riders where a very strong grip on the rider is necessary, for handicapped horseback riders with a spina bifida or other spinal handicaps where very firm and strong support from attendants is required, and for the rear rider in tandem vehicle riding such as motorcycle riding, bicycle riding, snowmobile riding or sled riding. The garment shown in FIGS. 7 and 8 includes a left region 158 and a right region 160, with a left vertical strap 162 in the left region 158 and a right vertical strap 164 in the right region 160, each of the straps 162, 164 having upper ends 166 and lower ends 168 and an intermediate region 170, each of the straps 172, 164 extending between the upper portion 42 and lower portion 46 of the covering 28, the upper end 166 of each strap 162, 164 being affixed to the covering 28 preferably by stitching in the upper portion 42 of the covering, the lower end 168 of each strap 162, 164 being affixed to the covering 28 in the lower portion 46 thereof, the intermediate region 170 of each strap being free of the covering 28, whereby each strap provides a handhold for a person other than the wearer. For purposes of defining the orientation of straps 162, 164, the line of demarcation between upper portion 42 and lower portion 46 of covering 28 is regarded as a line 172 halfway between each bottom end 130 of arm openings 126 and the lower end 72 of covering 28.

The garment of FIGS. 7 and 8 has reinforcing means including an upper reinforcing section 174 in the upper portion 92 of the garment and straddling the shoulder 44 of the wearer, and a lower reinforcing section 176 in the lower portion 46 of covering 28, the lower section 176 circumscribing the upper hip and lower back region 40 of the wearer. Also included are left and right reinforcing sections 178, 180, in, respectively, the left and right regions, 158, 160 of covering 28. Straps 162, 164 are connected at their ends 166, 168 to the reinforcing means 174, 176, 178, 180 so that stresses on the vertical straps 162, 164 are transferred therefrom to the hips and shoulders of the wearer.

The garment 26 shown in the embodiments of FIGS. 7 and 8 may also include a lower support member 78 and an upper support member 110. Support member 78 of FIG. 8 takes the same form as that of FIGS. 5 and 6, and upper support member 110 of FIG. 8 takes the same form as that of FIG. 6.

Embodiments other than those shown in FIGS. 7 and 8 may include reinforcing means, and in this regard a lower reinforcing means 176 for transferring stresses to the upper hip region 40 of the wearer is shown in FIGS. 2, 3, 5, and 6. In the embodiment of FIGS. 7 and 8, a collar 182 is shown. The other embodiments may also include a collar, and if they do the description with respect to neck opening 122 would apply to the junction 184 between the collar and main body of covering 28. Similarly, a garment according to the present invention may include sleeves (not shown) and in such instance, the foregoing description with respect to arm openings 126 would apply to the junction between the main body of covering 28 and the sleeves.

In all of the embodiments shown, upper support member 110 defines an upper passage 186 between it and the backside 36 of the garment 26, one end of each passage 186 being defined by lower aperture 118. In the embodiment of FIG. 6, another end of passage 186 is defined by upper aperture 152. See the broken-away sections of support member 110 in FIGS. 3, 5, and 6. Upper passage 186 accomodates and snugly engages the hand of an attendant.

While the present invention has been described in connection with certain specific embodiments, such description is by way of example only. Many modifications and variations to the specific embodiments disclosed are possible without departing from the spirit and scope of the invention.

What is claimed is:

1. A garment for aiding a handicapped wearer in riding horses under circumstances wherein a hand of an attendant is used to stabilize the rider on the horse, the garment comprising:

(a) means for covering the torso of the handicapped rider, said covering means having a back side for covering the rider's back, a front side for covering the rider's chest, an upper portion, coextensive with said front and back sides for covering the rider's shoulders and a lower portion for circumscribing the upper portion of the rider's hips;

(b) a closure in said front side of the garment;

(c) releasable fastening means on said front side of said garment and cooperating with said closure to firmly secure said covering means on the rider;

(d) upper means on said back side of said covering means for effecting engagement with an attendant's hand;

(e) said covering means having oppositely disposed arm openings wih top and bottom ends, and a neck opening;

(f) said upper means for effecting hand engagement including an upper horizontal support member of flexible, inelastic material having ends affixed to said covering means and an intermediate part which is free of the covering means;

(g) said upper horizontal support member extending across part of the back side of said covering means at a level between said top ends of said arm openings and said neck opening, on the one hand, and said bottom ends of said arm openings, on the other hand; and (h) lower means in said lower portion of said garment at the back side thereof for effecting engagement with an attendant's hand when in face-to-face engagement with the back side of the covering means near the lower portion of the garment;

(i) whereby a handicapped rider may be supported on a horse.

2. A garment for aiding a handicapped wearer as defined in claim 1 wherein:

(a) said covering means includes upper ends and lower ends, said upper portion terminating in said upper end, said lower portion terminating in said lower end;

(b) said lower means for effecting hand engagement includes:

(i) a lower support member of flexible inelastic material having a first part affixed to the lower portion of said covering means and second part which is free of said covering means;

(ii) a lower passage opening between said lower support member and said covering means, said lower passage facilitating insertion of the attendant's hand.

3. A garment for aiding a handicapped wearer as defined in claim 2 wherein said lower support member includes a frontwardly facing side and a rearwardly facing side, said frontwardly facing side being adapted for tight engagement with an attendant's hand, said rearwardly facing side facing exteriorly of the garment.

4. A garment for aiding a handicapped wearer as defined in claim 3 wherein said lower passage includes an upper and a lower opening, said upper opening facing upwardly toward said upper end of the covering means, said lower opening facing downwardly toward said lower end of the covering means.

5. A garment for aiding a handicapped wearer as defined in claim 4 wherein said lower support member is a horizontal strap having a central portion intermediate its ends, and wherein said first affixed part is disposed at the ends of said strap and said second free part is in said central portion of said strap.

6. A garment as defined in claim 1 wherein said upper support member includes an upper passage between said upper support member and said covering means, said upper support member also including a frontwardly facing surface and a rearwardly facing surface, said frontwardly facing surface being adapted for tight engagement with the back of an attendant's hand, said rearwardly facing surface facing exteriorly of the garment.

7. A garment as defined in claim 6 wherein said upper passage includes an upper aperture and a lower aperture, said upper aperture facing upwardly toward said upper end of the covering means, said lower aperture facing downwardly toward said lower end of the covering means.

8. A garment as defined in claim 7 wherein said upper support member is a horizontal strap.

9. A garment as defined in claim 1 wherein said horizontal support member is disposed at a level approximately halfway between, on the one hand, said top ends of said arm openings and said neck opening, and, on the other hand, said bottom ends of said arm openings, said horizontal support member being approximately centrally located with respect to the shoulder blades of the wearer.

10. A garment as defined in claim 1:

(a) wherein said covering means includes left and right regions; and (b) including a left vertical strap in said left region, and a right vertical strap in said right region, each of said straps having upper and lower ends and an intermediate region, each of said straps extending between said upper and lower portions of said covering means, the upper end of each strap being affixed to said covering means in the upper portion thereof, the lower end of each strap being affixed to said covering means in the lower portion thereof, the intermediate region of each strap being free of said covering means, whereby each strap provides a handhold for a person other than the wearer.

11. A garment as defined in claim 10 including reinforcing means in said covering means, said reinforcing means having an upper section in said upper portion of said garment and a lower section in said lower portion of said garment, said upper and lower ends of said vertical straps being affixed to said reinforcing means, whereby stresses are transferred from said vertical straps to the hips and shoulders of the wearer.

12. A garment as defined in claim 11 wherein:

(a) said upper hand engaging means includes a horizontal strap having ends fixed, respectively, in said left and right regions; and (b) said lower hand engagement means includes a horizontal strap having ends fixed, respectively, in said left and right regions.

13. A garment as defined in claim 12 wherein said reinforcing means includes a left section and a right section both of which are integral with said upper and lower sections, said ends of said upper and lower horizontal straps being affixed to said left and right reinforcement sections, whereby stresses in said upper and lower straps are transferred to the hips and shoulders of the wearer.

14. A garment for aiding a handicapped wearer in riding horses under circumstances wherein a hand of an attendant is used to stabilize the rider on the horse, the garment comprising:

(a) means for covering the torso of the handicapped rider, said covering means having a back side for covering the rider's back and a front side for covering the rider's chest, an upper portion coextensive with said front and back sides for covering the rider's shoulders and a lower portion for circumscribing the upper portion of the rider's hips;

(b) a closure in said front side of the garment;

(c) releasable fastening means on said front side of said garment and cooperating with said closure means to firmly secure said covering means on the rider;

(d) upper means on said back side of said covering means for effecting snug engagement with an attendant's hand when in face-to-face engagement with the back side of the covering means;

(e) said covering means having oppositely disposed arm openings with top and bottom ends, and a neck opening disposed at the base of the wearer's neck;

(f) said covering means including an upper end and a lower end;

(g) said upper means for effecting hand engagement including:

(i) an upper support member of flexible, inelastic material having a first part affixed to said covering means and second part which is free of said covering means;

(ii) an aperture between said support member and said covering means, said aperture facing downwardly toward the lower end of the covering means to facilitate upward insertion of the attendant's hand in a direction toward the upper end of the covering means;

(h) said upper support member extending horizontally across part of the back side of said covering means and vertically downwardly from said neck opening and said top of said arm openings to at least a level which is halfway between said tops and bottoms of said arm openings; and (i) lower means in said lower portion of said garment at the back side thereof for effecting engagement with an attendant's hand when in face-to-face engagement with the back side of the covering means near the lower portion of the garment;

(j) whereby a handicapped rider may be supported on a horse.

15. A garment as defined in claim 14 wherein said upper support member includes an auxiliary support member extending vertically downwardly therefrom, said auxiliary support member having upper and lower ends and an immediate region therebetween, said upper end of said auxiliary support member being integral with said second free part of said upper support member and being free of said covering means, said intermediate region of said auxiliary support member being free of said covering means, said lower end of said auxiliary support member being affixed to said back side of said covering means, said auxiliary support means providing a vertically disposed handle adapted for grasping by the attendant to support the handicapped wearer on a horse.

16. A garment as defined in claim 14 wherein said support member extends vertically downwardly a distance approximately equal to the length of an average human hand.

17. A garment as defined in claim 14 wherein said support member extends vertically downwardly to an extent falling in the range of 7–8 inches.

18. A garment as defined in claim 14 wherein said support member is closed at said upper end of said covering means opposite said lower aperture, said upper support member having the form of an inverted pocket adapted for insertion of an attendant's hand from below.

* * * * *